United States Patent [19]

Graser

[11] Patent Number: 4,577,693

[45] Date of Patent: Mar. 25, 1986

[54] WIRELINE APPARATUS

[76] Inventor: James A. Graser, Newton of Forbes, Alford, Aberdeenshire AB3 8PU, Scotland

[21] Appl. No.: 691,554

[22] Filed: Jan. 15, 1985

[30] Foreign Application Priority Data

Jan. 18, 1984 [GB] United Kingdom ..... 8401315

[51] Int. Cl.[4] ..... E21B 19/08

[52] U.S. Cl. ..... 166/338; 166/77; 166/385

[58] Field of Search ..... 166/335, 336, 337, 338, 166/339, 340, 341, 342, 343, 368, 385, 70, 72, 77, 67; 405/169, 170, 173, 195; 254/360, 361, 334, 336

[56] References Cited

U.S. PATENT DOCUMENTS 2,810,439 10/1957 McCullough et al. ..... 166/385 X 3,415,317 12/1968 Drivet ..... 166/336

3,924,686 12/1975 Arnold ..... 166/385

4,428,421 1/1984 Rankin ..... 166/77

*Primary Examiner*—James A. Leppink

*Assistant Examiner*—David J. Bagnell

*Attorney, Agent, or Firm*—Ratner & Prestia

[57] ABSTRACT

Wireline apparatus for subsea use in which a wireline is fed from a winch mechanism disposed within a housing, through the interior of the housing to a feed tube which engages on a wellhead assembly so that the interior of the feed tube communicates with a drill hole, the housing being in sealing engagement with the feed tube thereby to isolate the winch mechanism and wireline from the ambient subsea environment. The housing and feed tube together preferably form an inverted U and the winch mechanism is disposed with the free end of one arm of the U.

7 Claims, 5 Drawing Figures

WIRELINE APPARATUS

This invention relates to wireline apparatus.

When working at depth, for example in subsea oilfields, it is often necessary to supply and retrieve tools and other equipment from the operating area. This area may be hundreds of meters below the surface.

Hitherto, this task has been performed from semi-submersible drilling rigs by providing a tube or "lubricator" from the rig to the christmas tree of the wellhead and lowering or raising tools along the tube by means of a wire from a winch on the rig. However, heavy swells and waves at the surface of the sea can cause problems, as the rig moves up and down relative to the seabed. Further, this system is expensive.

When the task has to be performed from production platforms it has previously been proposed to provide a relatively short tube extending upwardly from the wellhead and to mount the winch underwater adjacent the tube. The tools to be provided at the wellhead are suspended within the tube on a wire from the winch, and the system is protected from ingress of seawater into the tube, and escape of oil into the sea through the tube, by means of a stuffing box at the upper end of the tube and through which the wire passes. However, problems can arise through failure of the stuffing box seal.

According to the present invention there is provided wireline apparatus for subsea use, comprising a feed tube for sealingly engaging a subsea wellhead so that the interior of the feed tube communicates in use with a subsea drill hole, a wireline extending within the feed tube and having means for receiving a tool to be transported into the drill hole, and a winch mechanism on which a portion of the wireline is secured and which is operable to feed the wireline through the feed tube, wherein the winch mechanism and the wireline are disposed within a common housing whose interior communicates sealingly with the interior of the feed tube to isolate the winch mechanism and the wireline from the ambient subsea environment.

The wireline may be a single- or multi-strand wire or cable.

The apparatus may be in the form of an inverted U-tube, one arm of the U being the feed tube (or "lubricator") and the other arm being the common housing. The winch mechanism is preferably disposed within the free end of said other arm. However, other arrangements may be adopted, for example with the winch mechanism adjacent the free end of the feed tube with a short housing between them.

The apparatus preferably includes a depth meter for measuring the extent of the wireline through the feed tube and within the drill hole. A tension meter may be provided for measuring the tension in the wireline. The tension meter may be in the form of a load cell.

Preferably also an upper portion of the apparatus is releasably engageable with the wellhead so that alternative tools and the like can be loaded onto the wireline at the surface for use at the wellhead.

An embodiment of the present invention will now be described by way of example with reference to the accompanying drawings, in which.

Figure 1:
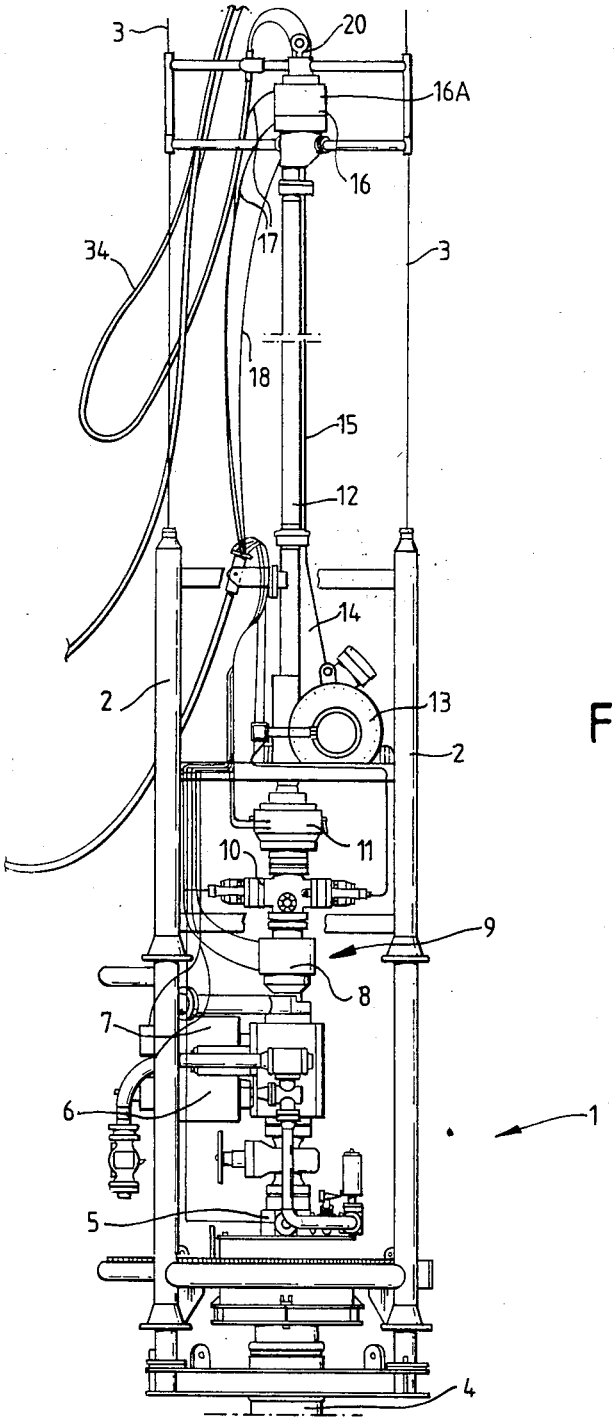
FIG. 1 is a front view of wireline apparatus of this invention in position at a subsea wellhead.

Referring to the drawings, a subsea wellhead has a christmas tree structure generally indicated at 1 and including four guide posts 2 of which only one pair of diagonally-disposed posts are shown. Guide wires 3 extend from the guide posts 2 to the surface. The wellhead has a number of valves for controlling flow of oil through a main line 4, namely a downhole safety valve 5, a master valve 6 and a swab valve 7. The wellhead assembly terminates at a hydraulically-operable automatically-engaging collet connector 8.

Figure 5:
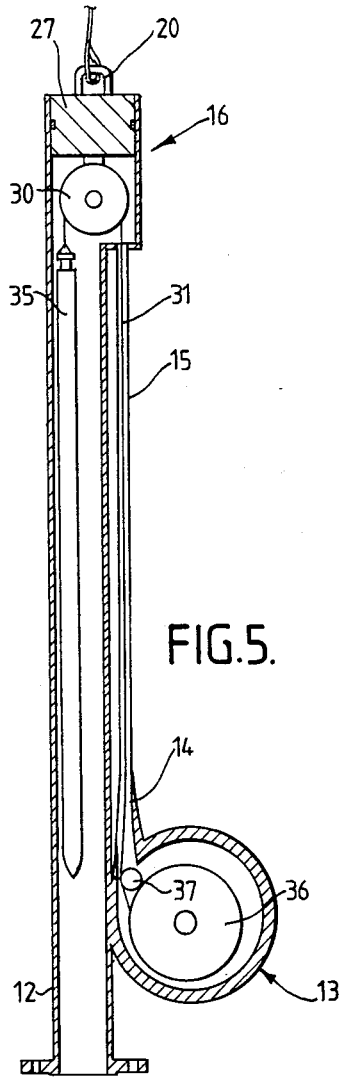
FIG. 5 is a schematic view of wireline apparatus of the invention.

Wireline apparatus of this embodiment of the invention is run along the guide wires 3 from the surface to lock onto the collet connector 8, and comprises an autolock connector 9, a pair of blow-out preventers 10, 11, a feed tube in the form of a lubricator 12, a winch 13, and a housing extending between the winch 13 and the lubricator 12. The housing is made up of walling 14 in sealing engagement with the winch 13, a tube 15 sealed to the walling 14 and a cap assembly 16 which includes an autolock connector 16A. The walling 14, tube 15, cap assembly 16 and lubricator 12 define a sealed passageway for a wire or cable 31 from which a replacement downhole tool 35 (FIG. 5) is suspended. The tool 35 may be, for example, a safety valve.

Figure 4:
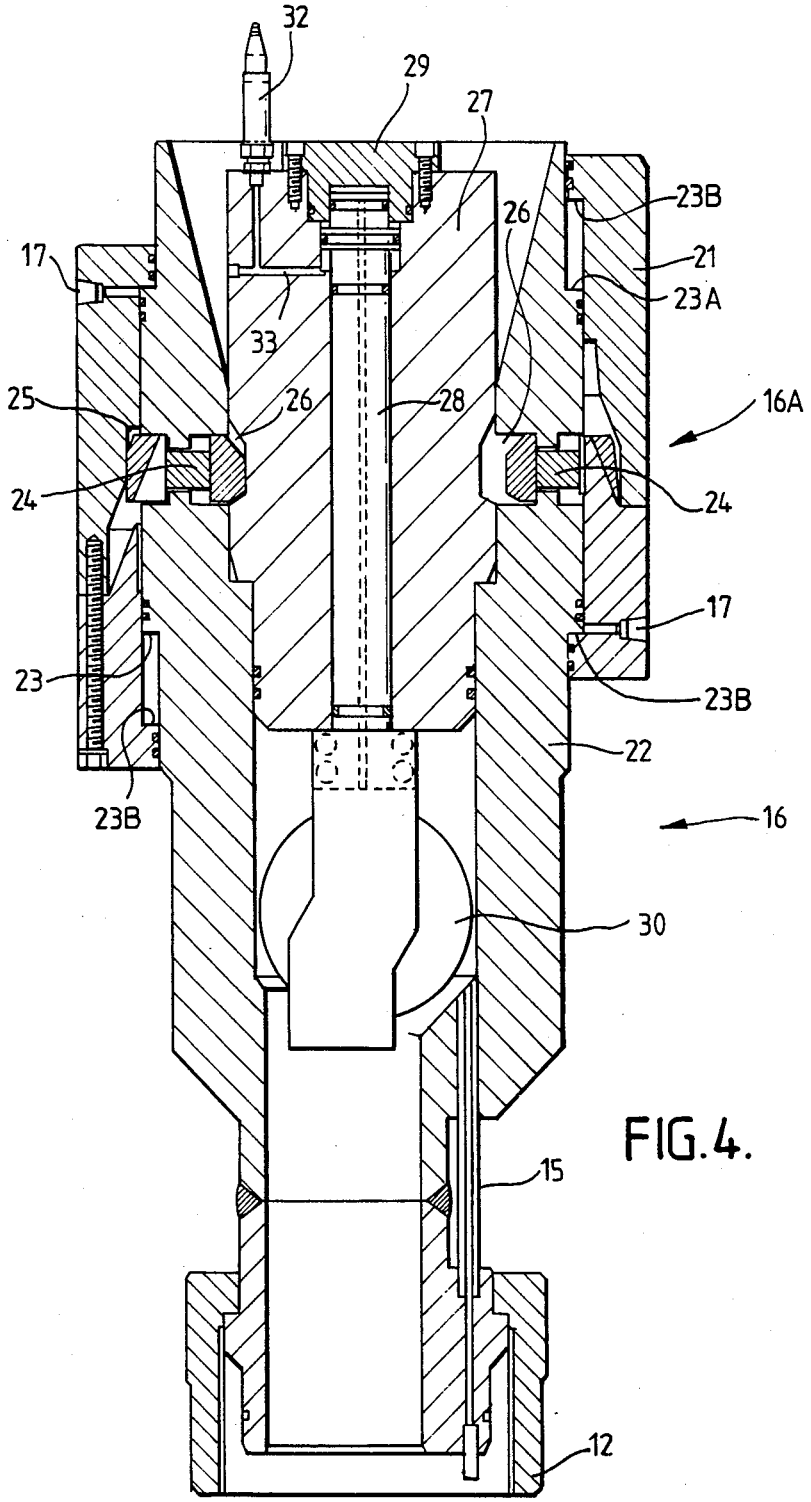
FIG. 4 is a sectional view of the cap assembly of the apparatus of FIG. 1.

The cap assembly 16 is shown in FIG. 4, and has the autolock connector 16A formed by an annular sleeve 21 slidable on an external cylindrical face of annular walling 22, the sleeve 21 being retained on the walling 22 between shoulders 23A and 23B on the walling 22 and sleeve 21 respectively. Lock members 24 extend through the walling 22 to engage at their outer ends in recesses 25 in the sleeve 21, and at their inner ends in recesses 26 in an outer face of a cylindrical cap 27. The position of the sleeve 21 on the walling 22 determines whether the lock members 24 can be released from the recesses 26, as can be seen in FIG. 4 where the sleeve 21 is shown in alternative positions on the left and right of the drawing.

The sleeve 21 is movable on the walling 22 in response to supply and exhaust of hydraulic fluid through lines 17 extending from the surface.

The cap 27 has a bore within which is a load cell formed by a pressure-compensated piston 28 engaging at its upper end a sealing member 29 and secured at its lower end to a pulley 30. The wire 31 passes into the cap assembly through the tube 15, around the pulley 30 and thence downwardly into the lubricator 12.

A pressure sensor 32 communicates with the piston 28 through a passageway 33 to measure the pressure which is directly proportioned to the total weight on the pulley 30.

An electronic counter (not shown) is connected to the pulley 30 to determine the number of turns of the pulley 30 in each direction, and thus operates as a measuring device for the length of the wire 31 extending below the pulley 30.

Signals from the pressure sensor 32 and the electronic counter are transmitted continuously to the surface through an umbilical line 34 (FIG. 1).

Figure 2:
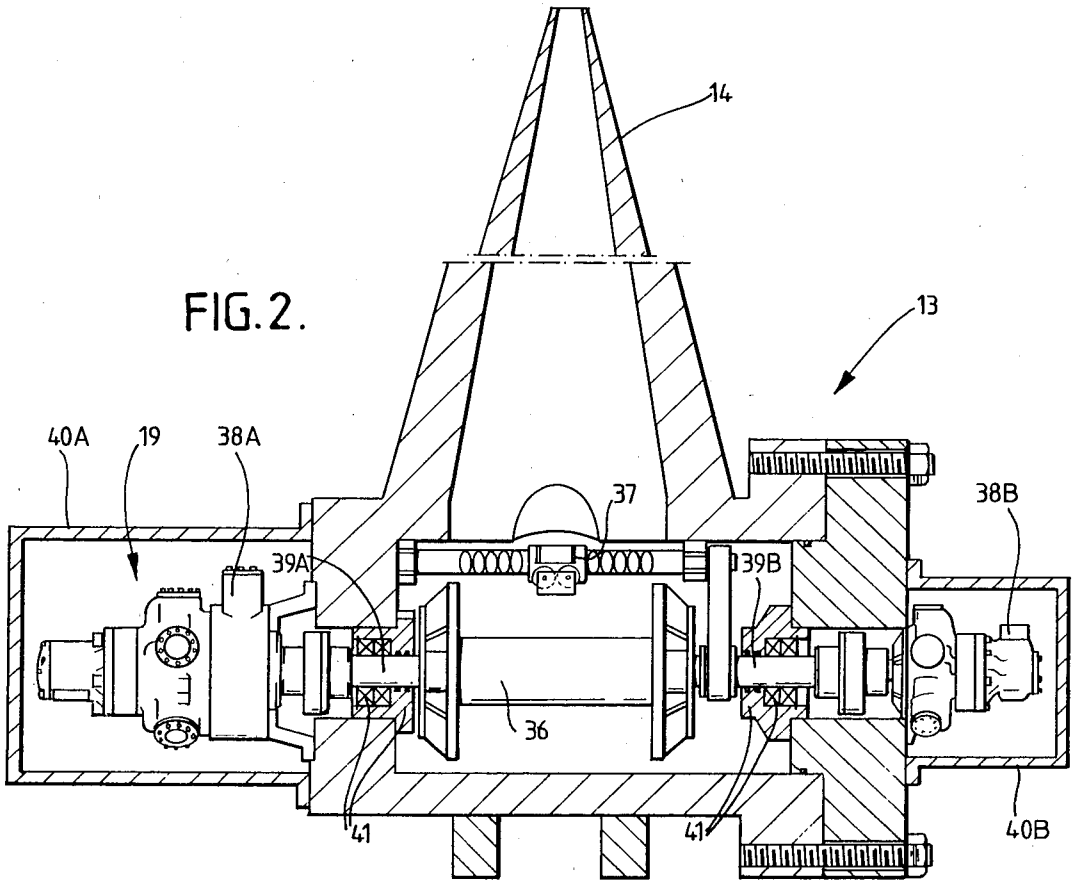
FIGS. 2 and 3 are respectively sectional front and side views of the winch mechanism used in this embodiment of the invention, the wireline being omitted from FIG. 2 for clarity.
Figure 3:
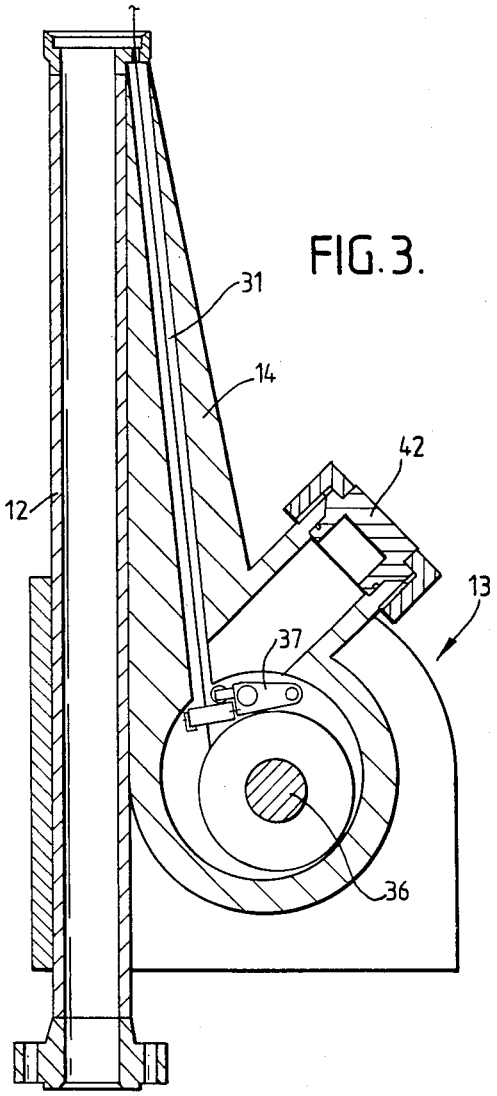

Referring to FIGS. 2 and 3 the winch 13 is located in a pressure vessel defined by the walling 14 and incorporates a drum 36, a spooler 37 and primary and back-up hydraulic motors 38A, 38B connected to the drum 36 by drive shafts 39A, 39B. The primary motor 38A is two-speed and has a brake mechanism; the back-up motor 38B, provided in case of failure of the primary motor 38A, has low-speed and neutral drives.

The motors 38A, 38B are in housings 40A, 40B and are subject to ambient sea pressure, and the coupling area between the motors and the drum 36 is vented to the surface to provide visual proof of the integrity of bearings and seals 41 around the shafts 39A, 39B where they pass through the walling 14. These seals 41 are rotating seals similar to centrifugal pump seals and as such are easy to maintain.

In the event of both motors 38A, 38B failing, divers can remove the housings 40A, 40B and replace the motors without interfering with the pressure vessel integrity.

An inspection hatch 42 is provided for viewing and monitoring the winch mechanism.

All controls, for example hydraulic power for the motors, brake, gear selector and seal vent, are carried to the surface through umbilicals.

The surface handling equipment consists of skids including the following functions:

1. winch handling systems
2. test stump
3. test pump and flushing system
4. umbilical handling winches
5. guidewire tensioning winches
6. diesel power plant/hydraulic pump
7. blow-out preventer/wellhead control system
8. wireline winch control system
9. electronic weight indicator and depth meter readout
10. shop and storage room The wireline apparatus is completely independent of the carrying vessel's utilities except for sea water and slop banks, and can be moved from vessel to vessel with minor modifications.

In use, a required tool 35, or supply of tools, is loaded onto the wire 31 at the surface and the wireline apparatus is lowered on the guide wires 3 until the automatic collet connector 8 is sealingly engaged by a corresponding standard connection on the lower blow-out preventor 10. This can be monitored by divers or remote-controlled television cameras. The lubricator 12 and other apparatus are then evacuated of seawater through the bleeder line 18, isolating the interior of the lubricator 12, cap assembly 16, tube 15 and walling 14 from the ambient environment. The valves 5, 6 and 7 are then opened and the winch 13 started by actuating the hydraulic motor 38A to drive the drum 36 and spooler 37, to lower the tool 35 on the wire 31 down through the lubricator 12 and into the wellhead, where it can be located in position. The motor 38A is then reversed to withdraw the wire 31.

If a further tool is required, the swab valve 7 is closed and the lubricator 12 bled off through the bleeder line 18 and flushed with water. Alternatively the lubricator 12 may be flushed with nitrogen gas prior to closure of the swab valve and bleeding of the lubricator 12. The sleeve 21 is then moved, by supply of hydraulic fluid through the upper line 17, to its raised position as shown on the righthand side of FIG. 5, whereupon the lock members 24 can disengage from the recesses 26 in the cap 27. The cap 27 is then raised to the surface by means of a lifting cable attached to a lug 20 on the sealing member 29 (FIG. 1), taking with it the piston 28 and pulley 30. This causes the wire 31 to feed out from the drum 36 against a constant low tension applied through the drum 36.

Once the pulley 30 reaches the surface a new tool can be connected to the wire 31, and the cap 27, piston 28, pulley 30 and tool are then lowered to re-engage on the walling 22 through the autolock connector 16A. The lubricator 12 is then pressure tested before the swab valve 7 is re-opened.

To remove the wireline apparatus at the conclusion of a job, the swab, master and safety valves 7, 6, 5 are closed. The lubricator 12 is flushed and bled. The swab valve 7 is pressure tested and checked for leakage. The control lines for the christmas tree are re-established to the surface by divers, the apparatus is lifted to the surface, and divers replace a corrosion cap on the wellhead assembly and release the guide wires.

The wireline apparatus of this embodiment of the invention allows rapid and simple supply of tools and other equipment to the wellhead without the fear of substantial pollution of the sea by oil. The wireline apparatus includes no stuffing boxes or other seals for passage of the wire, and this allows multi-stranded cables and other non-uniform lines to be used in place of a single-strand wire.

Modifications and improvements may be made without departing from the scope of the invention.

I claim:

1. Subsea wireline apparatus comprising (a) a feed tube sealingly engageable with a subsea wellhead so that the interior of the feed tube communicates in use with a subsea drill hole, (b) a wireline extending within the feed tube and having means for receiving a tool to be transported into the drill hole, (c) a housing whose interior communicates sealingly with the interior of the feed tube, the housing and the feed tube forming parallel arms of an inverted U-shaped passageway, (d) a winch mechanism disposed within the housing and having a portion of the wireline secured thereto, (e) a sealing cap in sealing engagement with the housing, (f) means for releasing the sealing cap from the housing, (g) connection means on the sealing cap for attachment of lifting means thereto, and (h) a pulley mounted on the sealing cap and around which the wireline passes.

2. Wireline apparatus as claimed in claim 1, wherein a tension meter is provided to indicate the tension in the wireline.

3. Wireline apparatus as claimed in claim 2, wherein the tension meter is provided in the form of a load cell engaging the pulley to indicate the tension in the wireline.

4. Wireline apparatus as claimed in claim 1, wherein the sealing cap is locked on the feed tube through a releasable collet connection.

5. Wireline apparatus as claimed in claim 1, wherein the feed tube is engageable with the subsea wellhead through a releasable collet connection.

6. Wireline apparatus as claimed in claim 1, including guide supports for engaging guide wires extending between the wellhead and the surface of the sea.

7. Wireline apparatus as claimed in claim 1, wherein the winch mechanism includes a winch drum driven by a hydraulic motor disposed externally of the housing and connected to the winch drum by a drive shaft which passes through a wall of the housing, the drive shaft being sealed to the wall of the housing to prevent passage of seawater into the housing.

* * * * *